US011041515B1

(12) United States Patent
Kondo et al.

(10) Patent No.: US 11,041,515 B1
(45) Date of Patent: Jun. 22, 2021

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 72 days.

(21) Appl. No.: 16/619,007

(22) PCT Filed: Jun. 14, 2018

(86) PCT No.: PCT/JP2018/022720

§ 371 (c)(1),
(2) Date: Dec. 3, 2019

(87) PCT Pub. No.: WO2018/230639

PCT Pub. Date: Dec. 20, 2018

(30) Foreign Application Priority Data

Jun. 16, 2017 (JP) ..... JP2017-118567

(51) Int. Cl.
*F15B 21/045* (2019.01)
*E02F 9/22* (2006.01)
*F04B 49/08* (2006.01)

(52) U.S. Cl.
CPC ..... *F15B 21/045* (2013.01); *E02F 9/2235* (2013.01); *E02F 9/2296* (2013.01); *F04B 49/08* (2013.01); *E02F 9/2285* (2013.01); *F15B 2211/20546* (2013.01); *F15B 2211/6309* (2013.01); *F15B 2211/6316* (2013.01); *F15B 2211/6652* (2013.01); *F15B 2211/6654* (2013.01)

(58) Field of Classification Search
CPC ..... F15B 21/045; F04B 49/08
USPC ..... 60/433, 434, 452
See application file for complete search history.

(56) References Cited

U.S. PATENT DOCUMENTS 5,758,499 A * 6/1998 Sugiyama ..... F04B 49/065 60/450
7,543,448 B2 * 6/2009 Nakamura ..... E02F 9/2235 60/431

(Continued)

FOREIGN PATENT DOCUMENTS

JP H07-077168 A 3/1995
JP H08-121344 A 5/1996
JP 2013-002541 A 1/2013

*Primary Examiner* — Michael Leslie
(74) *Attorney, Agent, or Firm* — Oliff PLC

(57) ABSTRACT

A hydraulic system includes: a regulator that adjusts a tilting angle of a pump; and a controller that controls the regulator such that a discharge flow rate of the pump is a lower one of an operation-requiring flow rate and a horsepower control flow rate. The controller stores a first horsepower control line and a second horsepower control line lower than the first control line. When an operating point exceeds the first horsepower control line, the controller decreases the tilting angle of the pump; when the operating point falls below the second horsepower control line, the controller increases the tilting angle of the pump. When the operating point exceeds the first control line or falls below the second control line, it is shifted and positioned between the first control line and the second horsepower control line, keeping the tilting angle of the pump as it is.

2 Claims, 4 Drawing Sheets

(56) References Cited

U.S. PATENT DOCUMENTS

| | | | | |
|---|---|---|---|---|
| 8,266,903 | B2 * | 9/2012 | Kowatari | F04B 17/05 60/449 |
| 8,322,481 | B2 * | 12/2012 | Satake | F16H 61/46 180/307 |
| 8,904,777 | B2 * | 12/2014 | Koga | F04B 49/08 60/434 |
| 9,032,726 | B2 * | 5/2015 | Sora | E02F 9/2075 60/431 |

* cited by examiner

HYDRAULIC SYSTEM

TECHNICAL FIELD

The present invention relates to a hydraulic system of an electrical positive control type.

BACKGROUND ART

Conventionally, construction machines and industrial machines adopt a hydraulic system of an electrical positive control type (see Patent Literature 1, for example). Generally speaking, in a hydraulic system, hydraulic oil is supplied from a variable displacement pump to a hydraulic actuator via a control valve, and the tilting angle of the pump is adjusted by a regulator. In a hydraulic system of an electrical positive control type, a controller controls the regulator, such that the discharge flow rate of the pump increases in accordance with increase in the operating amount of an operation device intended for moving the hydraulic actuator.

Such a hydraulic system of an electrical positive control type often performs horsepower control in order to prevent a stall of an engine that drives the pump. In this case, the controller controls the regulator, such that the discharge flow rate of the pump is a lower one of an operation-requiring flow rate corresponding to the operating amount of the operation device and a horsepower control flow rate corresponding to the discharge pressure of the pump.

CITATION LIST

Patent Literature

PTL 1: Japanese Laid-Open Patent Application Publication No. 2013-2541

SUMMARY OF INVENTION

Technical Problem

However, if the horsepower control is performed by quickly operating the operation device to a great degree, then as shown in FIG. 5, the discharge flow rate of the pump may increase and decrease repeatedly, causing hunting in the behavior of the hydraulic actuator. Specifically, when an operating point that is determined by the discharge pressure and the discharge flow rate of the pump exceeds a horsepower control line that defines a relationship between the discharge pressure of the pump and the horsepower control flow rate (i.e., point a in the drawing), the tilting angle of the pump is decreased. In accordance therewith, the discharge flow rate of the pump decreases, and the discharge pressure of the pump decreases. As a result, the operating point falls below the horsepower control line (i.e., point b in the drawing). Therefore, the tilting angle of the pump is increased. In accordance therewith, the discharge flow rate of the pump increases, and the discharge pressure of the pump increases. As a result, the operating point exceeds the horsepower control line again (i.e., point c in the drawing). Generally speaking, hunting in the behavior of the hydraulic actuator due to such repeated increase/decrease in the discharge flow rate of the pump is likely to occur, except in a case where the temperature of the hydraulic oil is low to a certain extent (e.g., a case where the outside air temperature is low and the warming up of the machine is not completed).

In general, it is often the case that a measure, such as adding a restrictor to the hydraulic line of the regulator, is taken in order to prevent the hunting in the behavior of the hydraulic actuator. However, in the case of adopting such a configuration, it is known that there is a problem of delayed response when the temperature of the hydraulic oil is low.

In view of the above, an object of the present invention is to provide a hydraulic system that makes it possible to suppress hunting in the behavior of a hydraulic actuator while preventing a problem from occurring due to the temperature of the hydraulic oil being low.

Solution to Problem

In order to solve the above-described problems, a hydraulic system of the present invention includes: an operation device that outputs an operation signal corresponding to an operating amount of an operating unit; a variable displacement pump; a regulator that adjusts a tilting angle of the pump; a pressure sensor that detects a discharge pressure of the pump; and a controller that controls the regulator such that a discharge flow rate of the pump is a lower one of an operation-requiring flow rate and a horsepower control flow rate, the operation-requiring flow rate corresponding to the operation signal outputted from the operation device, the horsepower control flow rate corresponding to the discharge pressure of the pump detected by the pressure sensor. The controller stores therein a first horsepower control line and a second horsepower control line, the first horsepower control line defining a relationship between the discharge pressure of the pump and the horsepower control flow rate, the second horsepower control line being lower than the first horsepower control line. In a case where the operation signal outputted from the operation device has increased and the operation-requiring flow rate corresponding to the operation signal outputted from the operation device is higher than the horsepower control flow rate corresponding to the discharge pressure of the pump detected by the pressure sensor, the controller: until an operating point that is determined by the discharge pressure of the pump detected by the pressure sensor and the discharge flow rate of the pump exceeds the first horsepower control line, adjusts the tilting angle of the pump to a tilting angle corresponding to the operation-requiring flow rate; when the operating point has exceeded the first horsepower control line, decreases the tilting angle of the pump to a tilting angle determined by the first horsepower control line; when the operating point has fallen below the second horsepower control line, increases the tilting angle of the pump to a tilting angle determined by the second horsepower control line; and when the operating point that has exceeded the first horsepower control line is shifted and positioned between the first horsepower control line and the second horsepower control line, or when the operating point that has fallen below the second horsepower control line is shifted and positioned between the first horsepower control line and the second horsepower control line, keeps the tilting angle of the pump as it is.

According to the above configuration, a hysteresis is provided between the first horsepower control line and the second horsepower control line. The first horsepower control line is a determination criterion whether or not to decrease the tilting angle of the pump when performing the horsepower control, and the second horsepower control line is a determination criterion whether or not to increase the tilting angle of the pump when performing the horsepower control. Accordingly, when the tilting angle of the pump is changed, and thereby the operating point is shifted and positioned between the first horsepower control line and the second horsepower control line, the tilting angle of the pump is not changed any further. Thus, repeated increase/decrease in the discharge flow rate of the pump can be suppressed, and thereby hunting in the behavior of a hydraulic actuator can be suppressed, by a simple configuration without requiring the installation of additional components. Moreover, the hunting is suppressed by the electronic control performed by the controller without using a component, such as a restrictor, whose characteristics significantly change depending on the temperature (particularly when the temperature is low). Therefore, the problem due to the temperature of the hydraulic oil being low is prevented from occurring. This makes it possible to realize the hydraulic system, which is excellent in terms of stability over a temperature range of the hydraulic oil from a low temperature to a normal operating temperature (i.e., the temperature after the warming up is completed).

In the case where the operation signal outputted from the operation device has increased and the operation-requiring flow rate corresponding to the operation signal outputted from the operation device is higher than the horsepower control flow rate corresponding to the discharge pressure of the pump detected by the pressure sensor, if a temperature of hydraulic oil is lower than a predetermined value, the controller may decrease or increase the tilting angle of the pump by using the first horsepower control line without using the second horsepower control line. According to this configuration, simple control using the first horsepower control line can be performed, except when the temperature of the hydraulic oil is relatively high and hunting in the behavior of the hydraulic actuator is likely to occur. This makes it possible to utilize the motive power of, for example, an engine to a greater degree.

Advantageous Effects of Invention

The present invention makes it possible to suppress hunting in the behavior of the hydraulic actuator while preventing a problem from occurring due to the temperature of the hydraulic oil being low.

DESCRIPTION OF EMBODIMENTS

Figure 1:
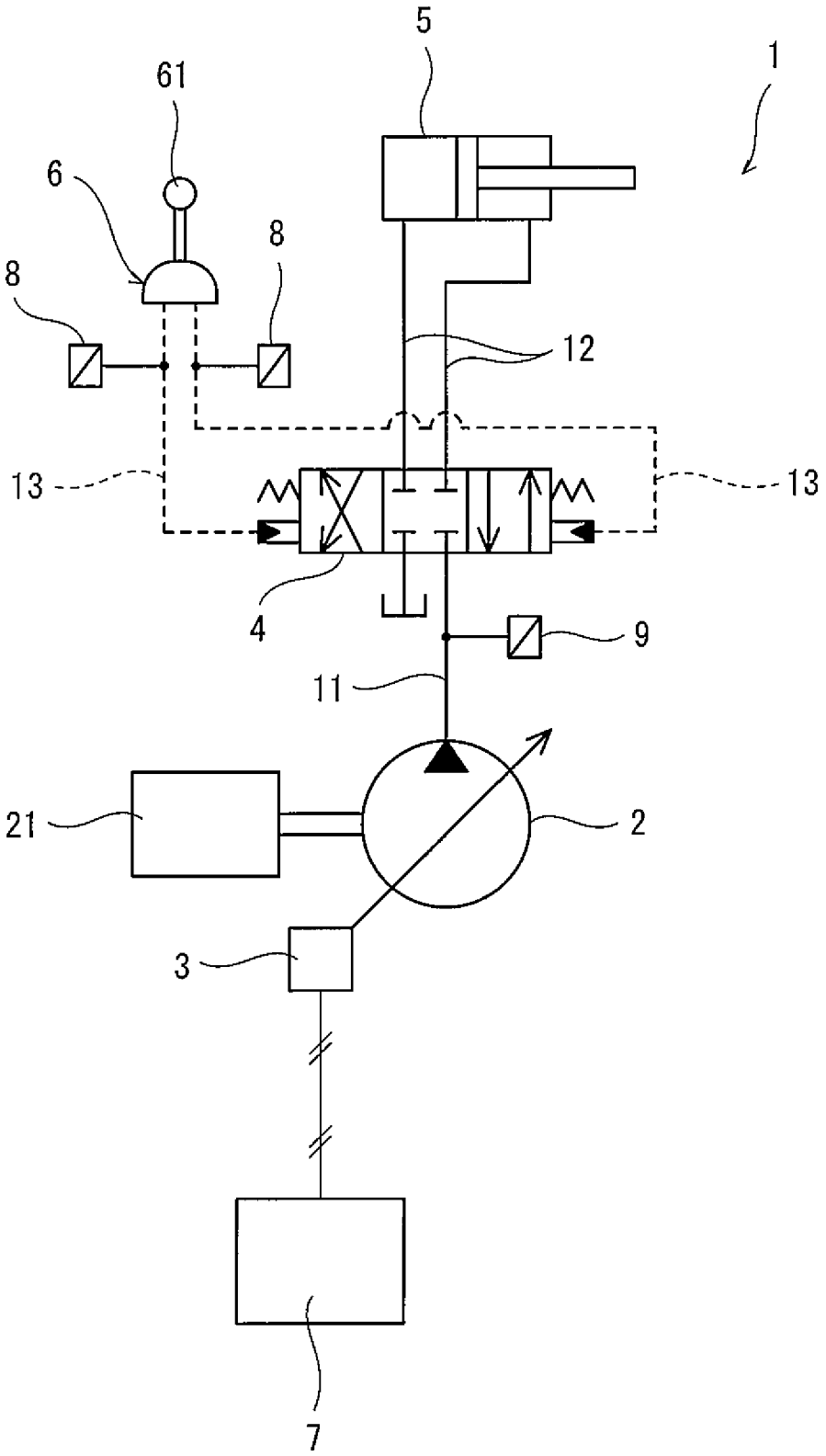
FIG. 1 shows a schematic configuration of a hydraulic system according to one embodiment of the present invention.

FIG. 1 shows a hydraulic system 1 according to one embodiment of the present invention. For example, the hydraulic system 1 is installed in a construction machine, such as a hydraulic excavator or a hydraulic crane, or in a civil engineering machine, an agricultural machine, or an industrial machine.

Specifically, the hydraulic system 1 includes: a hydraulic actuator 5; and a pump 2, which supplies hydraulic oil to the hydraulic actuator 5 via a control valve 4. In the illustrated example, the number of sets of the hydraulic actuator 5 and the control valve 4 is one. However, as an alternative, the number of sets of the hydraulic actuator 5 and the control valve 4 may be plural.

The pump 2 is driven by an engine 21. Alternatively, the pump 2 may be driven by an electric motor. The pump 2 is a variable displacement pump (a swash plate pump or a bent axis pump) whose tilting angle is changeable. The tilting angle of the pump 2 is adjusted by a regulator 3.

The pump 2 is connected to the control valve 4 by a supply line 11. The discharge pressure of the pump 2 is kept to a relief pressure or lower by an unshown relief valve.

In the present embodiment, the hydraulic actuator 5 is a double-acting cylinder, and the control valve 4 is connected to the hydraulic actuator 5 by a pair of supply/discharge lines 12. However, as an alternative, the hydraulic actuator 5 may be a single-acting cylinder, and the control valve 4 may be connected to the hydraulic actuator 5 by a single supply/discharge line 12. Further alternatively, the hydraulic actuator 5 may be a hydraulic motor.

As a result of an operation device 6 being operated, the position of the control valve 4 is switched from a neutral position to a first position (a position for moving the hydraulic actuator 5 in one direction) or to a second position (a position for moving the hydraulic actuator 5 in a direction opposite to the one direction). In the present embodiment, the control valve 4 is a hydraulic pilot control valve that includes a pair of pilot ports. However, as an alternative, the control valve 4 may be a solenoid pilot control valve.

The operation device 6 includes an operating unit 61, and outputs an operation signal corresponding to an operating amount of the operating unit 61. That is, the operation signal outputted from the operation device 6 increases in accordance with increase in the operating amount. The operating unit 61 is, for example, an operating lever. Alternatively, the operating unit 61 may be a foot pedal or the like.

In the present embodiment, the operation device 6 is a pilot operation valve that outputs a pilot pressure as the operation signal. Accordingly, the operation device 6 is connected to the pilot ports of the control valve 4 by a pair of pilot lines 13. The control valve 4 increases the opening area of a passage through which the hydraulic oil is supplied to the hydraulic actuator 5 in accordance with increase in the pilot pressure (operation signal) outputted from the operation device 6.

The aforementioned regulator 3 is moved by an electrical signal. For example, in a case where the pump 2 is a swash plate pump, the regulator 3 may electrically change the hydraulic pressure applied to a servo piston coupled to the swash plate of the pump 2, or may be an electric actuator coupled to the swash plate of the pump 2.

The regulator 3 is controlled by a controller 7. For example, the controller 7 includes a CPU and memories such as a ROM and RAM, and the CPU executes a program stored in the ROM.

The controller 7 is electrically connected to pressure sensors 8, which are provided on the aforementioned pair of pilot lines 13, respectively. It should be noted that FIG. 1 shows only part of signal lines for simplifying the drawing.

Figure 2:
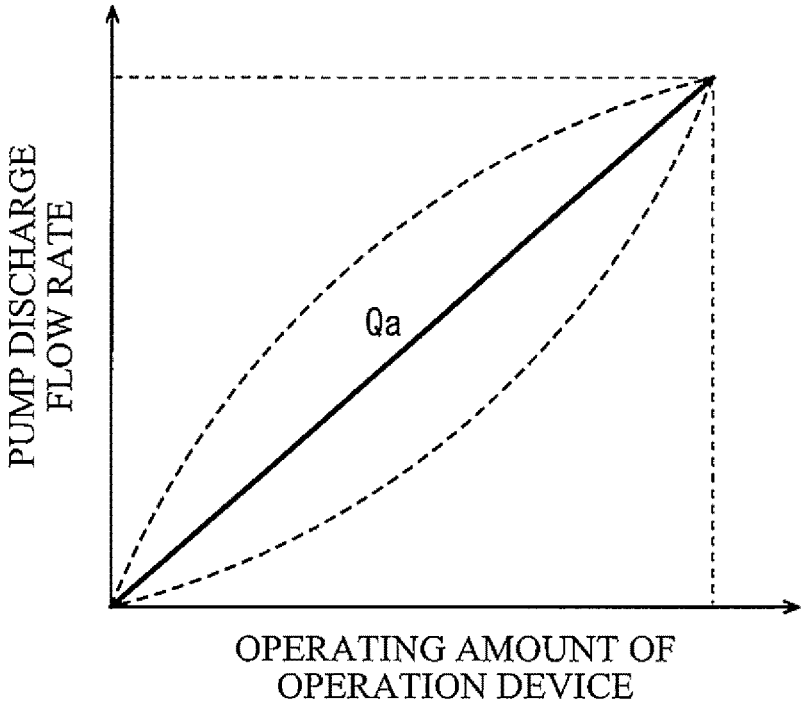
FIG. 2 is a graph showing an operation-requiring flow rate.

Each pressure sensor 8 detects the pilot pressure outputted from the operation device 6. As shown in FIG. 2, the controller 7 determines an operation-requiring flow rate Qa corresponding to the pilot pressure (operation signal) detected by the pressure sensor 8. That is, the operation-requiring flow rate Qa increases in accordance with increase in the pilot pressure. In the present embodiment, the operation-requiring flow rate Qa is proportional to the pilot pressure. However, a relationship line representing a relationship between the operation-requiring flow rate Qa and the operation signal is not necessarily a straight line, but may be a convex upward or convex downward curve as indicated by dashed line in FIG. 2.

The controller 7 is electrically connected also to a pressure sensor 9 provided on the supply line 11. The pressure sensor 9 detects the discharge pressure of the pump 2. The controller 7 determines a horsepower control flow rate Qb corresponding to the discharge pressure of the pump 2 detected by the pressure sensor 9.

Figure 3:
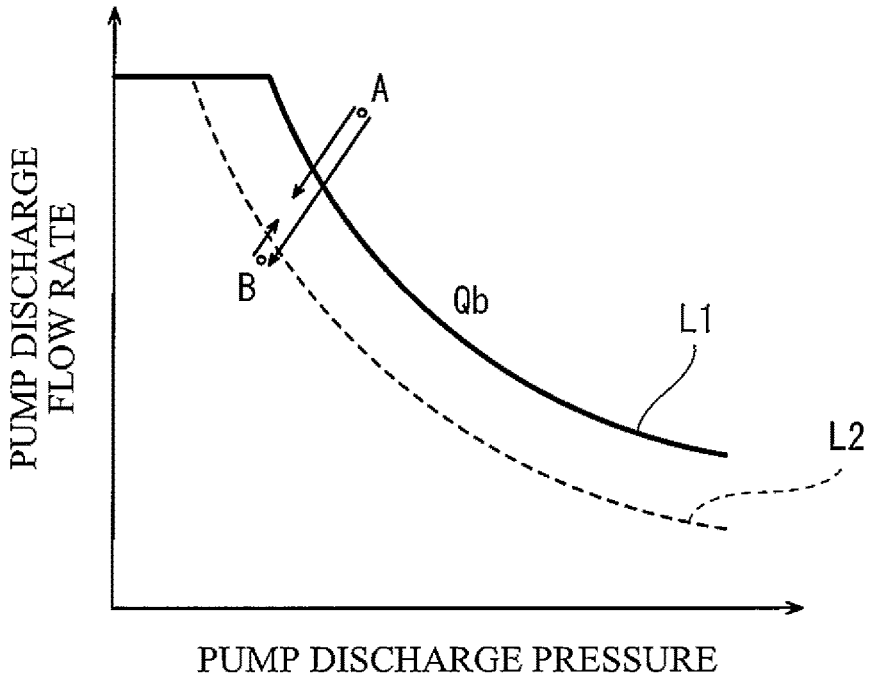
FIG. 3 is a graph showing shifting of an operating point relative to a first horsepower control line and a second horsepower control line.

Specifically, as shown in FIG. 3, the controller 7 stores therein a first horsepower control line L1, which defines a relationship between the discharge pressure of the pump 2 and the horsepower control flow rate Qb. The controller 7 determines the horsepower control flow rate Qb based on the first horsepower control line L1.

In the present embodiment, the maximum value of the operation-requiring flow rate Qa and the maximum value of the horsepower control flow rate Qb are substantially equal to each other. However, as an alternative, the maximum value of the operation-requiring flow rate Qa and the maximum value of the horsepower control flow rate Qb may be different from each other. The relationship between the maximum value of the operation-requiring flow rate Qa and the maximum value of the horsepower control flow rate Qb is the same also when, in a case where the number of sets of the hydraulic actuator 5, the control valve 4, and the operation device 6 is plural, each operation device 6 is operated alone.

After the operation-requiring flow rate Qa and the horsepower control flow rate Qb are determined, the controller 7 controls the regulator 3, such that the discharge flow rate of the pump 2 is a lower one of the operation-requiring flow rate Qa and the horsepower control flow rate Qb.

In the present embodiment, as shown in FIG. 3, the controller 7 further stores therein a second horsepower control line L2 lower than the first horsepower control line L1. In other words, the second horsepower control line L2 defines a second horsepower control flow rate lower than the aforementioned horsepower control flow rate Qb.

In the present embodiment, the shape of the second horsepower control line L2 is similar to the shape of the first horsepower control line L1. For example, the second horsepower control line L2 defines a discharge flow rate that is 70 to 98% of a discharge flow rate defined by the first horsepower control line L1. However, it is not essential that the shape of the second horsepower control line L2 be similar to the shape of the first horsepower control line L1. For example, the interval between the first horsepower control line L1 and the second horsepower control line L2 may be small at the low discharge pressure side, and may be large at the high discharge pressure side.

In the present embodiment, the second horsepower control line L2 is used in a case where special acceleration conditions are satisfied and when the temperature of the hydraulic oil is higher than a predetermined value (the predetermined value is, for example, 40 to 50° C.). The case where the special acceleration conditions are satisfied is a case where the operation signal outputted from the operation device 6 has increased (i.e., the operating amount of the operation device 6 has increased in order to accelerate the hydraulic actuator 5) and the operation-requiring flow rate Qa corresponding to the operation signal outputted from the operation device 6 is higher than the horsepower control flow rate Qb corresponding to the discharge pressure of the pump 2 detected by the pressure sensor 9.

That is, even in a case where the special acceleration conditions are satisfied, if the temperature of the hydraulic oil is lower than the predetermined value, only the first horsepower control line L1 is used. Also in a case where the special acceleration conditions are not satisfied, i.e., in a case where the operation signal outputted from the operation device 6 is constant or decreases, only the first horsepower control line L1 is used. Alternatively, in a case where the special acceleration conditions are satisfied, the second horsepower control line L2 may always be used regardless of the temperature of the hydraulic oil.

In a case where the controller 7 uses only the first horsepower control line L1, when the operation-requiring flow rate Qa is higher than the horsepower control flow rate Qb, the controller 7 decreases or increases the tilting angle of the pump 2, such that an operating point that is determined by the discharge pressure of the pump 2 detected by the pressure sensor 9 and the discharge flow rate of the pump 2 is kept on the first horsepower control line L1. The discharge flow rate of the pump 2 is obtained by multiplying the rotational speed of the engine 21 by a pump displacement per rotation. The pump displacement per rotation is obtained from the tilting angle of the pump 2.

The temperature of the hydraulic oil may be detected by a temperature sensor provided on a tank storing the hydraulic oil. Alternatively, a temperature sensor detecting the atmospheric temperature may be adopted, and a case where the temperature detected by the temperature sensor is higher than a threshold may be assumed as a case where the temperature of the hydraulic oil is higher than the predetermined value. Further alternatively, the temperature of the coolant of the engine 21 can be treated as the temperature of the hydraulic oil.

In a case where the special acceleration conditions are satisfied and when the temperature of the hydraulic oil is higher than the predetermined value, the controller 7 adjusts the tilting angle of the pump 2 to a tilting angle corresponding to the operation-requiring flow rate Qa until the operating point that is determined by the discharge pressure of the pump 2 detected by the pressure sensor 9 and the discharge flow rate of the pump 2 exceeds the first horsepower control line L1.

When the operating point has exceeded the first horsepower control line L1 (i.e., point A in FIG. 3), the controller 7 decreases the tilting angle of the pump 2 to a tilting angle determined by the first horsepower control line L1 (i.e., a tilting angle corresponding to a point on the first horsepower control line L1, the point corresponding to the current discharge pressure). As a result, if the operating point that has exceeded the first horsepower control line L1 is shifted and positioned between the first horsepower control line L1 and the second horsepower control line L2, the controller 7 keeps the tilting angle of the pump 2 as it is.

Alternatively, when the operating point has fallen below the second horsepower control line L2 as a result of decreasing the tilting angle of the pump 2 (i.e., point B in FIG. 3), the controller 7 increases the tilting angle of the pump 2 to a tilting angle determined by the second horsepower control line L2 (i.e., a tilting angle corresponding to a point on the second horsepower control line L2, the point corresponding to the current discharge pressure). As a result, if the operating point that has fallen below the second horsepower control line L2 is shifted and positioned between the first horsepower control line L1 and the second horsepower control line L2, the controller 7 keeps the tilting angle of the pump 2 as it is.

As described above, in the hydraulic system 1 of the present embodiment, a hysteresis is provided between the first horsepower control line L1 and the second horsepower control line L2. The first horsepower control line L1 is a determination criterion whether or not to decrease the tilting angle of the pump 2 when performing the horsepower control, and the second horsepower control line L2 is a determination criterion whether or not to increase the tilting angle of the pump 2 when performing the horsepower control. Accordingly, when the tilting angle of the pump 2 is changed, and thereby the operating point is shifted and positioned between the first horsepower control line L1 and the second horsepower control line L2, the tilting angle of the pump 2 is not changed any further. Thus, repeated increase/decrease in the discharge flow rate of the pump 2 can be suppressed, and thereby hunting in the behavior of the hydraulic actuator 5 can be suppressed, by a simple configuration without requiring the installation of additional components. Moreover, the hunting is suppressed by the electronic control performed by the controller without using a component, such as a restrictor, whose characteristics significantly change depending on the temperature (particularly when the temperature is low). Therefore, the problem due to the temperature of the hydraulic oil being low is prevented from occurring. This makes it possible to realize the hydraulic system 1, which is excellent in terms of stability over a temperature range of the hydraulic oil from a low temperature to a normal operating temperature (i.e., the temperature after the warming up is completed) without scarifying the responsiveness even when the operation device 6 is operated quickly.

Figure 4A:
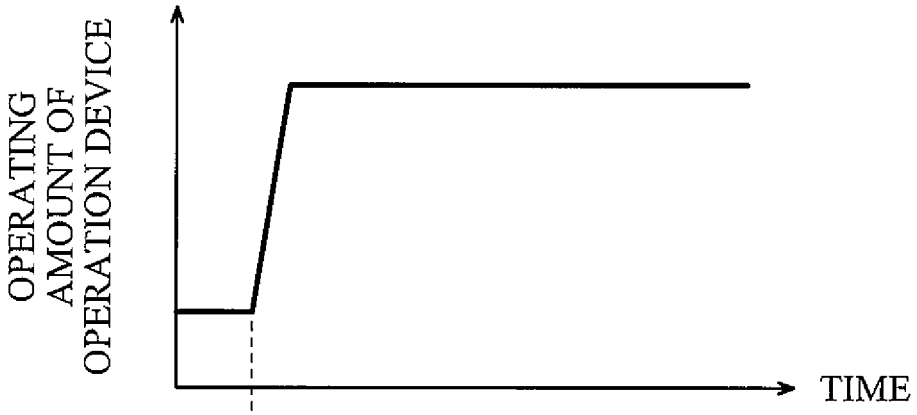
FIG. 4A shows temporal changes in the operating amount of an operation device.
Figure 4B:
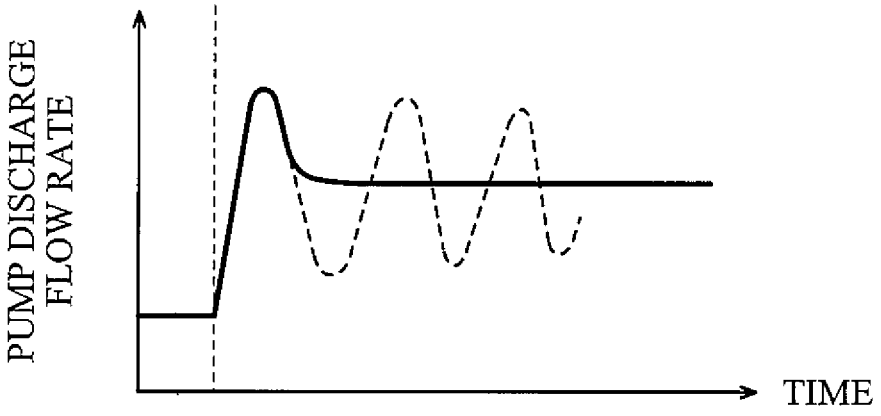
FIG. 4B shows temporal changes in the discharge flow rate of a pump.
Figure 5:
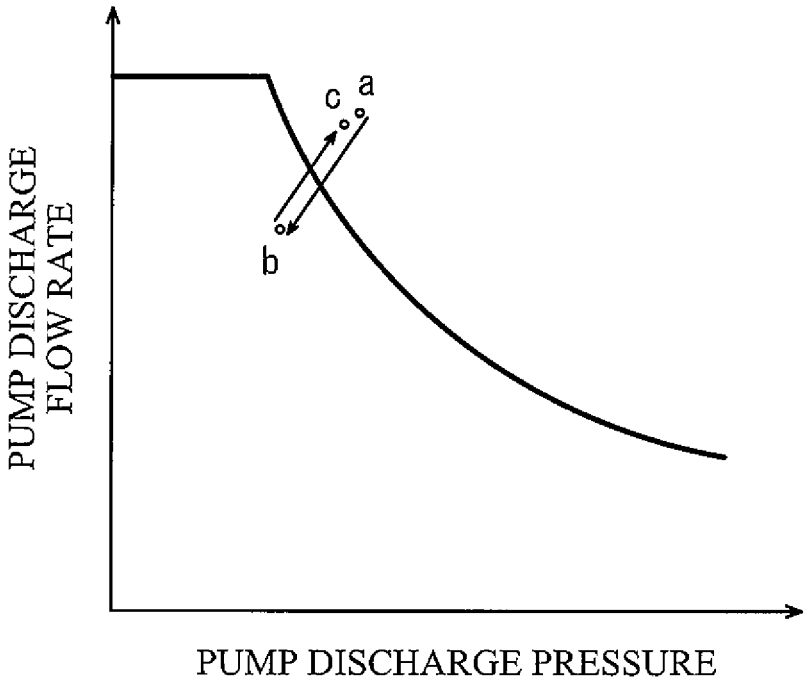
FIG. 5 is a graph showing shifting of an operating point relative to a horsepower control line in a conventional hydraulic system.

For example, assume a case where only the first horsepower control line L1 is used as in the conventional art. In this case, after the warming up is completed, if the operation device is operated quickly to a great degree as shown in FIG. 4A when the atmospheric temperature is low, the discharge flow rate of the pump 2 repeatedly increases and decreases as indicated by dashed line in FIG. 4B. This causes hunting in the behavior of the hydraulic actuator. On the other hand, in a case where the second horsepower control line L2 is used in addition to the first horsepower control line L1 as in the present embodiment, the repeated increase/decrease in the discharge flow rate of the pump 2 can be suppressed as indicated by solid line in FIG. 4B, and thereby hunting in the behavior of the hydraulic actuator 5 can be suppressed.

Further, in the present embodiment, even in a case where the special acceleration conditions are satisfied, if the temperature of the hydraulic oil is lower than the predetermined value, the second horsepower control line L2 is not used. Accordingly, simple control using the first horsepower control line L1 can be performed, except when the temperature of the hydraulic oil is relatively high and hunting in the behavior of the hydraulic actuator 5 is likely to occur. This makes it possible to utilize the motive power of, for example, the engine 21 to a greater degree.

(Variations)

The present invention is not limited to the above-described embodiment. Various modifications can be made without departing from the spirit of the present invention.

For example, the operation device 6 may be an electrical joystick that outputs an electrical signal as the operation signal to the controller 7. In this case, the pressure sensors 8 are unnecessary, and each pilot port of the control valve 4 is connected to a secondary pressure port of a solenoid proportional valve.

REFERENCE SIGNS LIST

1 hydraulic system
2 pump
3 regulator
4 control valve
5 hydraulic actuator
6 operation device
61 operating unit
7 controller
8, 9 pressure sensor

The invention claimed is:

1. A hydraulic system comprising:

an operation device that outputs an operation signal corresponding to an operating amount of an operating unit;

a variable displacement pump;

a regulator that adjusts a tilting angle of the pump;

a pressure sensor that detects a discharge pressure of the pump; and a controller that controls the regulator such that a discharge flow rate of the pump is a lower one of an operation-requiring flow rate and a horsepower control flow rate, the operation-requiring flow rate corresponding to the operation signal outputted from the operation device, the horsepower control flow rate corresponding to the discharge pressure of the pump detected by the pressure sensor, wherein the controller stores therein a first horsepower control line and a second horsepower control line, the first horsepower control line defining a relationship between the discharge pressure of the pump and the horsepower control flow rate, the second horsepower control line being lower than the first horsepower control line, and in a case where the operation signal outputted from the operation device has increased and the operation-requiring flow rate corresponding to the operation signal outputted from the operation device is higher than the horsepower control flow rate corresponding to the discharge pressure of the pump detected by the pressure sensor, the controller:

until an operating point that is determined by the discharge pressure of the pump detected by the pressure sensor and the discharge flow rate of the pump exceeds the first horsepower control line, adjusts the tilting angle of the pump to a tilting angle corresponding to the operation-requiring flow rate;

when the operating point has exceeded the first horsepower control line, decreases the tilting angle of the pump to a tilting angle determined by the first horsepower control line;

when the operating point has fallen below the second horsepower control line, increases the tilting angle of the pump to a tilting angle determined by the second horsepower control line; and when the operating point that has exceeded the first horsepower control line is shifted and positioned between the first horsepower control line and the second horsepower control line, or when the operating point that has fallen below the second horsepower control line is shifted and positioned between the first horsepower control line and the second horsepower control line, keeps the tilting angle of the pump as it is.

2. The hydraulic system according to claim 1, wherein in the case where the operation signal outputted from the operation device has increased and the operation-requiring flow rate corresponding to the operation signal outputted from the operation device is higher than the horsepower control flow rate corresponding to the discharge pressure of the pump detected by the pressure sensor, if a temperature of hydraulic oil is lower than a predetermined value, the controller decreases or increases the tilting angle of the pump by using the first horsepower control line without using the second horsepower control line.

* * * * *